US005257695A

United States Patent [19]

Henke et al.

[11] Patent Number: 5,257,695

[45] Date of Patent: Nov. 2, 1993

[54] TOOL KIT WITH PROJECTING TOOL HANDLE

[75] Inventors: David R. Henke, Maple Grove; David J. Ruha, St. Louis Park, both of Minn.

[73] Assignee: Warner Manufacturing Company, Minneapolis, Minn.

[21] Appl. No.: 29,351

[22] Filed: Mar. 4, 1993

Related U.S. Application Data

[63] Continuation of Ser. No. 822,426, Jan. 17, 1992, abandoned.

[51] Int. Cl.[5] ..... B65D 85/20

[52] U.S. Cl. ..... 206/373; 206/229; 206/374; 206/375

[58] Field of Search ..... 206/372-375, 206/349, 229, 230, 575, 582

[56] References Cited

U.S. PATENT DOCUMENTS

| | | | |
|---|---|---|---|
| 978,358 | 12/1910 | Colby | 206/373 |
| 2,800,221 | 7/1957 | Butler et al. | 206/375 |
| 3,840,113 | 10/1974 | Bartleson | 206/575 |
| 4,202,464 | 5/1980 | Mohs et al. | 220/339 |
| 4,380,293 | 4/1983 | Wilcox et al. . | |
| 4,416,372 | 11/1983 | Polk | 206/372 |
| 4,449,629 | 5/1984 | Barrieau . | |
| 4,570,818 | 2/1986 | Borst et al. | 220/339 |
| 4,834,237 | 5/1989 | Henke et al. | 206/373 |
| 4,899,877 | 2/1990 | Kiernan | 206/349 |
| 4,938,355 | 7/1990 | Rocco | 206/372 |
| 5,029,706 | 7/1991 | McCracken | 206/349 |
| 5,029,707 | 7/1991 | Feng | 206/374 |

FOREIGN PATENT DOCUMENTS

| | | | |
|---|---|---|---|
| 51374 | 12/1920 | Sweden | 206/374 |

OTHER PUBLICATIONS

Warner catalog sheet showing Drywall Tools, 1984-1985, p. 19, of the Warner Manufacturing Company.

Warner catalog sheet showing Drywall Tools, 1990-1991, p. 20, of the Warner Manufacturing Company.

*Primary Examiner*—Bryon P. Gehman

*Attorney, Agent, or Firm*—Merchant Gould Smith Edell Welter & Schmidt

[57] ABSTRACT

A tool kit having a housing with a top cover portion and a bottom container portion. A plurality of tools being vertically stacked within the housing so as to prevent both vertical and horizontal movement of the tools. A handle of one of the tools projecting from the housing.

18 Claims, 6 Drawing Sheets

TOOL KIT WITH PROJECTING TOOL HANDLE

This is a continuation of application Ser. No. 07/822,426, filed Jan. 17, 1992, now abandoned.

BACKGROUND OF THE INVENTION

This invention relates to a tool kit and a method of packaging tools.

Various types of containers have been proposed and utilized for the storing of tool sets which include a multiplicity of separate tools. In recent years, there has been an increasing tendency to facilitate the marketing of products by providing containers which could be used not only for display of the products on the point of purchase display units such as pegboard displays, but also to serve as a permanent storage case which the purchaser could continue to use for the product. Examples of such containers may be found in U.S. Pat. No. 4,380,293 to Donald G. Wilcox dated Apr. 19, 1983 and U.S. Pat. No. 4,449,629 to Paul B. Barrieau dated May 22, 1984.

The present invention offers improvements over the prior art and solves many problems associated with the prior art.

SUMMARY OF THE INVENTION

The present invention relates to a tool kit and a method of packaging tools.

One advantage of an embodiment of the present invention is the provision of a tool kit wherein the handle of one of the tools is used to carry the entire package.

In one embodiment, the tool kit comprises a housing having a top cover and a bottom container and also several tools. In one embodiment, the tools include a hand taping knife, a hand broad knife and a hand sander. A piece of sand paper and an instruction booklet are also present in the housing. The handle of the hand taping knife extends from the housing so that a user can carry the entire package by grasping the handle and also the whole tool kit can be hung by the handle extending from the housing.

Still another embodiment has the advantage of the top cover portion of the housing being made of a clear plastic so at least some of the contents of the housing are visible whereby the housing can be used as a display package.

A further advantage of one embodiment of the present invention is the provision of a tool kit wherein the tools are vertically disposed in the tool kit housing and are supported thereby so as to prevent vertical movement of the tools relative to one another.

Yet another advantage of one embodiment of the present invention is that the top cover includes recesses configured to receive two or more of the tools so that there is no horizontal movement of the tools in the recesses.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings in which like reference numerals and letters indicate corresponding parts throughout the several views.

DETAILED DESCRIPTION OF A PREFERRED EMBODIMENT OF THE INVENTION

Figure 1:
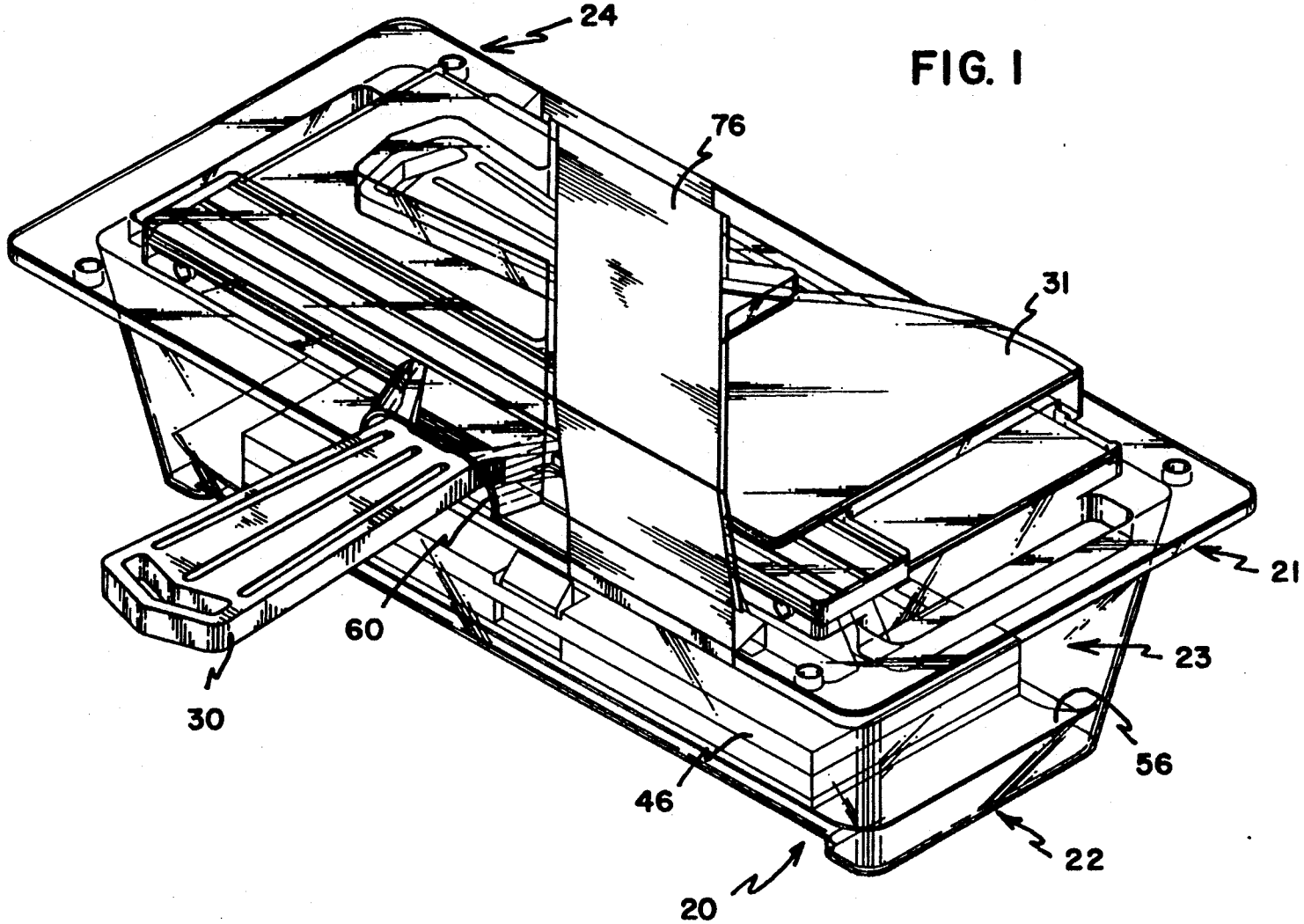
FIG. 1 is a perspective view of an embodiment of a tool kit in accordance with the principles of the invention.

Referring now to FIG. 1, 2A,B and 3A,B, there is shown a preferred embodiment of a tool kit in accordance with the principles of the present invention, the tool kit being generally designated by the reference numeral 20. The tool kit 20 includes a clear plastic housing 21, having a transparent bottom container portion 22 and a transparent top cover portion 24, and a plurality of tools 23. In alternate embodiments, the bottom container portion 22 and/or the top cover portion 24 might be opaque or translucent. The bottom container portion 22 and the top cover portion 24 define a space for storing the tools 23. It will be appreciated that various types of tools might be packaged in the housing 21. In the embodiment shown, the tools 23 include a sander 46, a broad knife 31, and a taping knife 30. Embodiments of those tools are shown in FIG. 4 through 7. In addition, in the embodiment shown, a piece of sand paper 56 and an instruction booklet 58 are also included in the housing 21.

Figure 4:
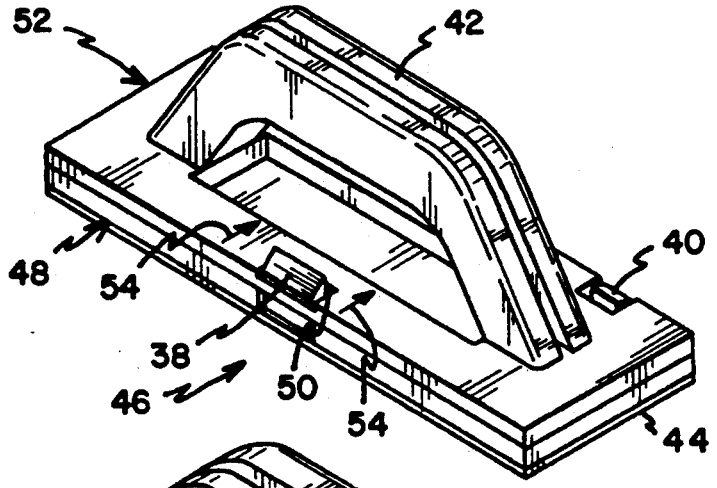
FIG. 4 is a perspective view of an embodiment of a sander tool present in the tool kit of FIG. 1.
Figure 5:
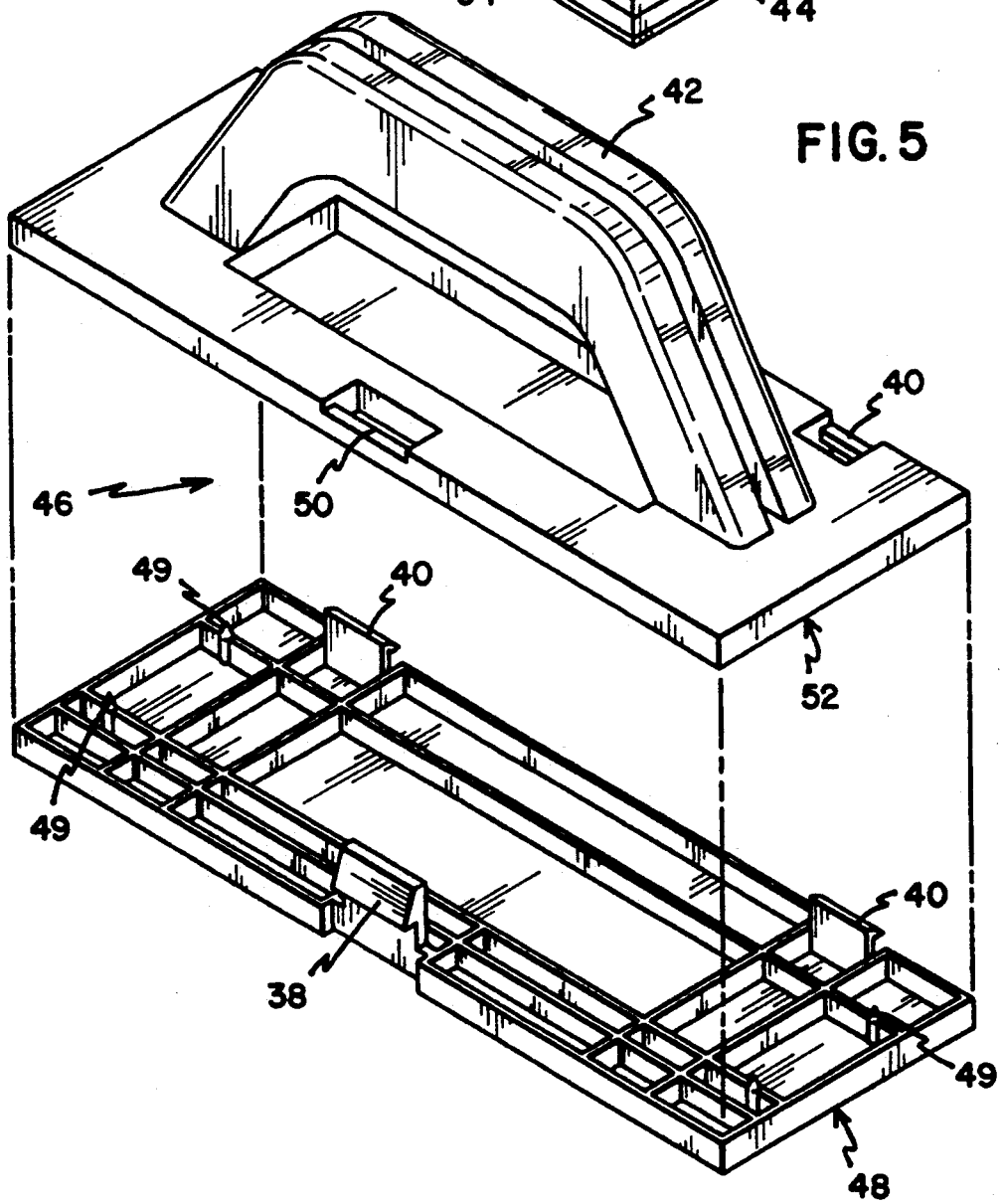
FIG. 5 is a perspective view of the sander shown in FIG. 4 with the sander being separated into its two parts, a top part and a bottom part.

Illustrated in FIG. 4,5 is embodiment of the sander 46. An embodiment of this sander 46 is disclosed in U.S. Pat. No. 4,885,876. The sander 46 includes a bottom part 48, and a top part 52. The bottom part 48 and the top part 52 are removably retained together by a push button 38 and two hinge members 40 which are located on the bottom part 48. The sander top part 52 has a handle 42. A sponge-like surface 44 is disposed underneath the bottom part 48 of the sander 46. In use, the push button 38 is pushed generally in the direction of arrows 54, so as to separate the sander 46 into its two parts by pivoting about the two hinge members 40. The sand paper 56 is placed below the sponge-like surface 44 of the bottom part 48 of the sander 46 and the ends of the sand paper are inserted between the two parts 48, 52 and attached to retaining pins 49 of the bottom part 48.

The two parts 48, 52 are then reattached to hold the sand paper 56.

Figure 6:
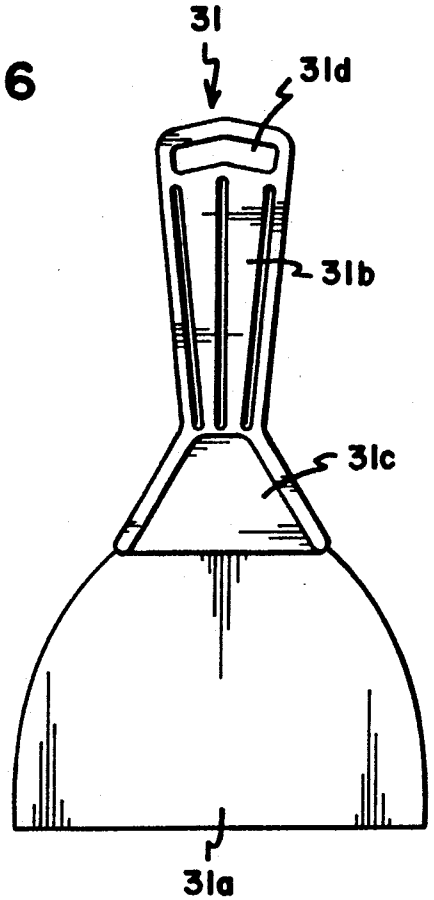
FIG. 6 is a perspective view of an embodiment of a broad knife present in the tool kit of FIG. 1.

Illustrated in FIG. 6, there is shown an embodiment of the broad knife 31. The broad knife 31 comprises a broad knife blade portion 31*a*, a broad knife handle portion 31*b*, and a broad knife blade support portion 31*c*. An opening 31*d* is present in the handle portion 31*b*.

Figure 7:
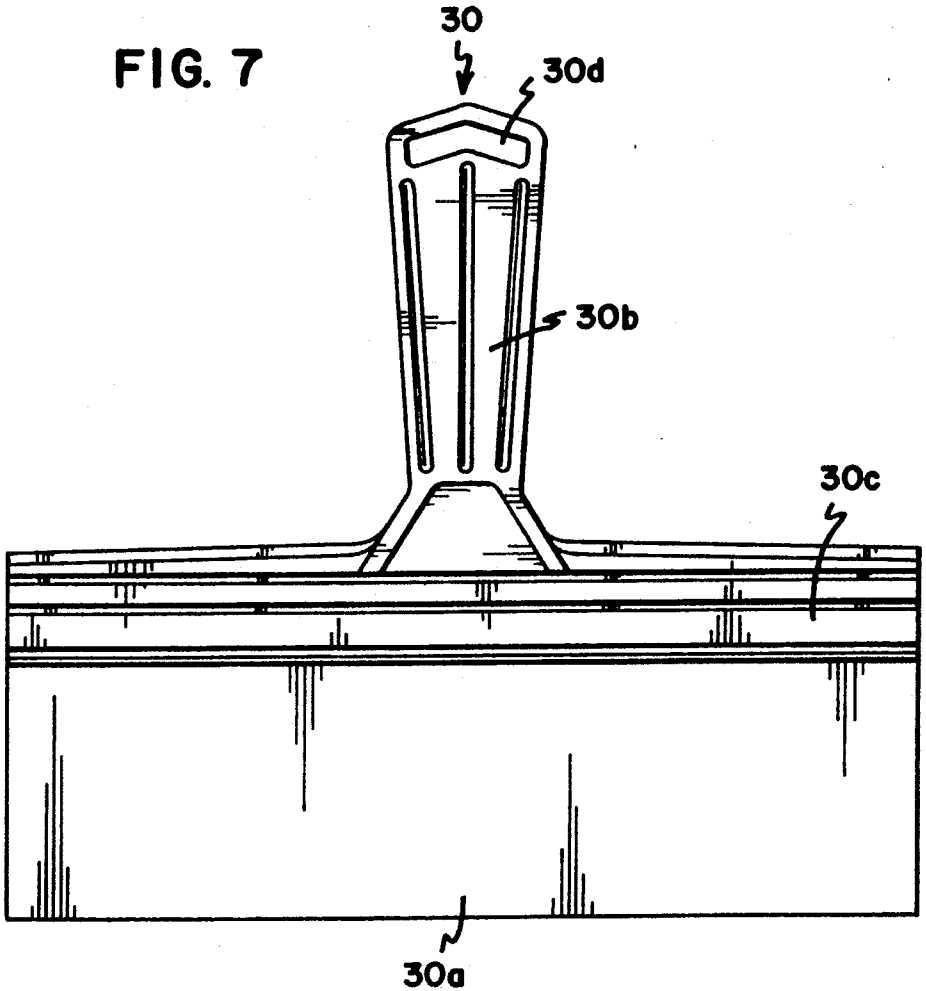
FIG. 7 is a perspective view of an embodiment of a taping knife present in the tool kit of FIG. 1.

Illustrated in FIG. 7, there is shown an embodiment of the taping knife 30. The taping knife 30 comprises a taping knife blade portion 30*a*, a taping knife handle portion 30*b*, and a taping knife blade support portion 30*c*. An opening 30*d* is present in the handle portion 30*b*.

Figure 2C:
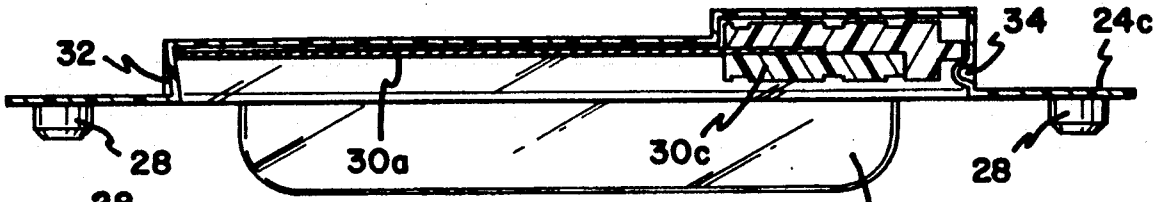
FIG. 2C is a sectional view as seen generally along line 2C—2C of FIG. 2A.
Figure 2A:
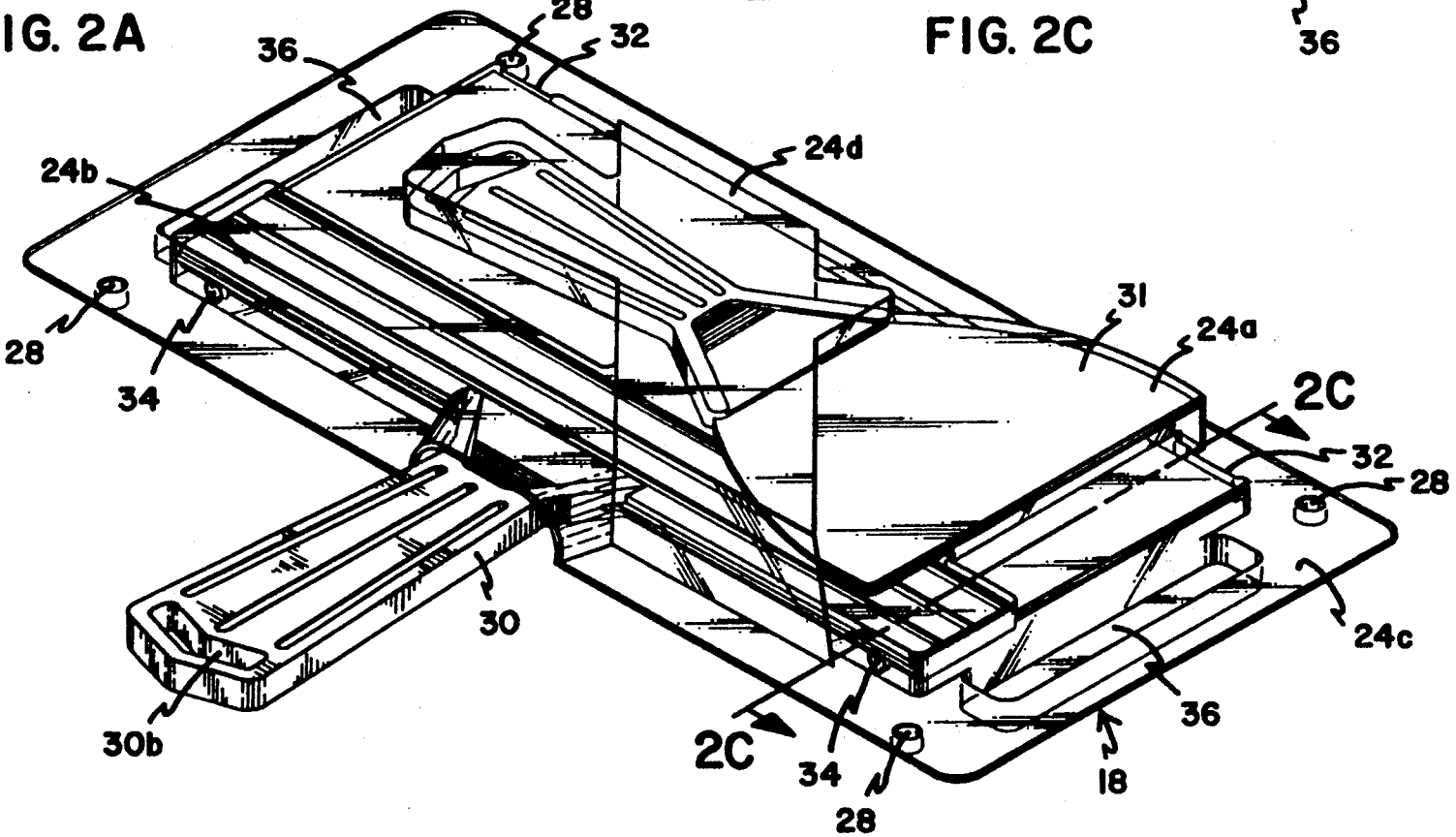
FIG. 2A,B are perspective views of a top cover portion of the tool kit, wherein tools are present in the top cover portion in FIG. 2A and are removed from the top cover portion in FIG. 2B.
Figure 2B:
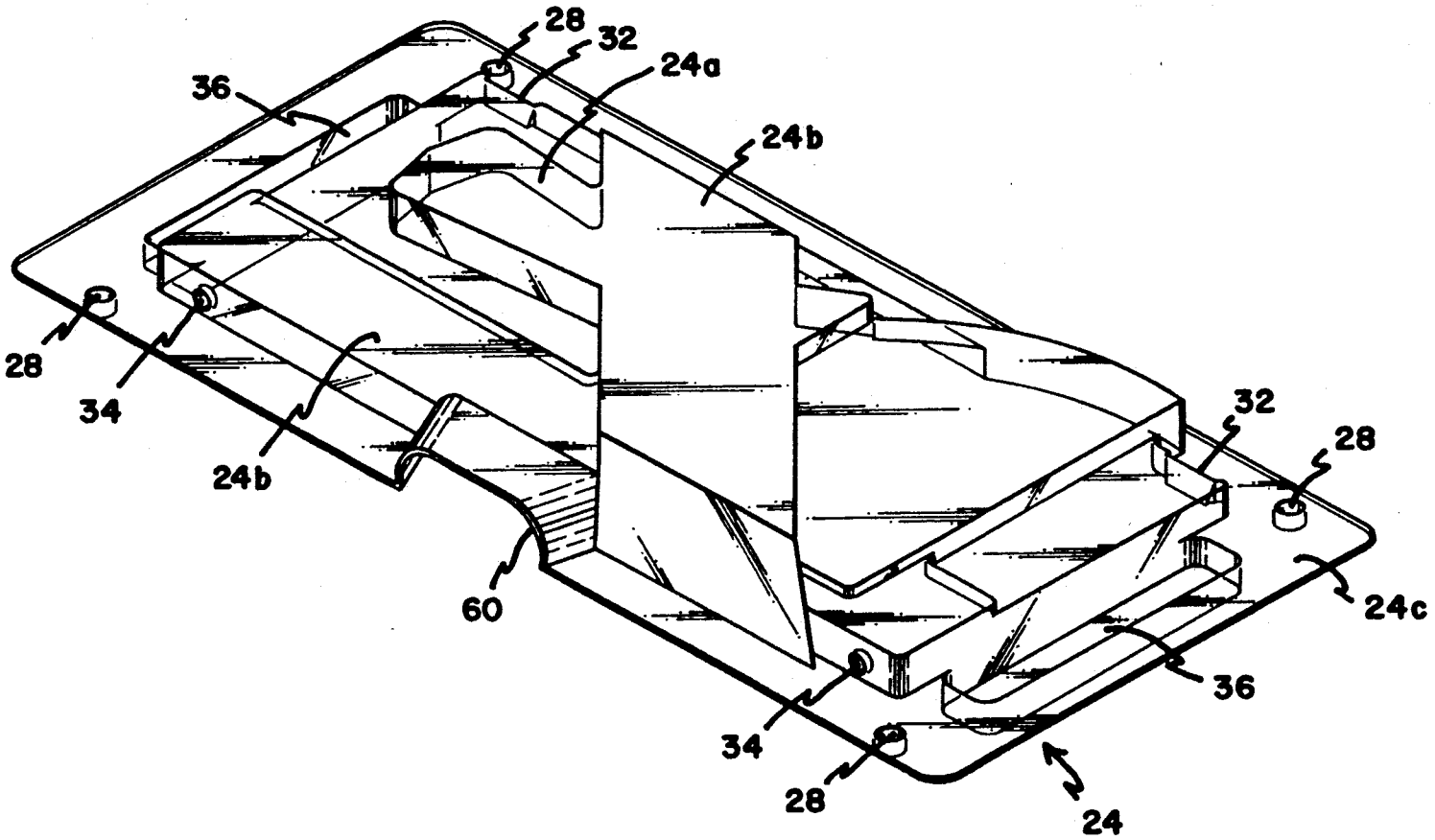

Referring further now to FIG. 2A,B, disposed in a recess 24*a* of the top cover portion 24 is the broad knife 31. The blade portion 30*a* and the blade support portion 30*c* of the taping knife 30 are disposed in a recess 24*b* of the top cover portion 24 below the broad knife 31. The recesses 24*a,b* are configured so as to allow substantially no horizontal movement of the broad knife 31 and the taping knife 30. The tools 23 disposed in the top cover portion 24, namely the broad knife 31 and the taping knife 30, and the top cover portion 24 itself will collectively be referred to as a tool kit top assembly portion 18.

As further illustrated in FIG. 2A,B, two cylindrical projections 34 are disposed along a side of the top cover portion 24 and project inwardly. Two inwardly projecting, inclined walls or undercuts 32 are disposed along a side of the top cover portion 24 opposite the side where the cylindrical projections 34 are located. These four projections shown in the FIG. 2A,B are used to retain the taping knife 30 within the top cover portion 24. The inclined walls or undercuts 32 engage one side of the blade 30*a* of the taping knife 30 and the cylindrical projections 34 engage one side of the blade support portion 30*c* of the taping knife 30. The broad knife 31, in turn, is retained within the top cover portion 24 by the taping knife 30. The taping knife 30 and the broad knife 31 are thus held in a fixed relationship to one another in the top cover portion 24 allowing substantially no vertical movement of the tools. Thus, there is substantially no movement, horizontal and vertical, of the tools 23 in the top cover portion 24.

In addition, an open notch 60 is defined in the top cover portion 24 for receiving the handle portion 30*b* of the taping knife 30 such that the handle portion 30*b* projects out from the top cover portion 24. Accordingly, the handle portion 30*b* can be used to carry the tool kit 20. In one embodiment of the taping knife 30, the handle portion 30*b* includes the opening 30*d* such that the tool kit 20 can be hung on a wall or a display unit.

Figure 3A:
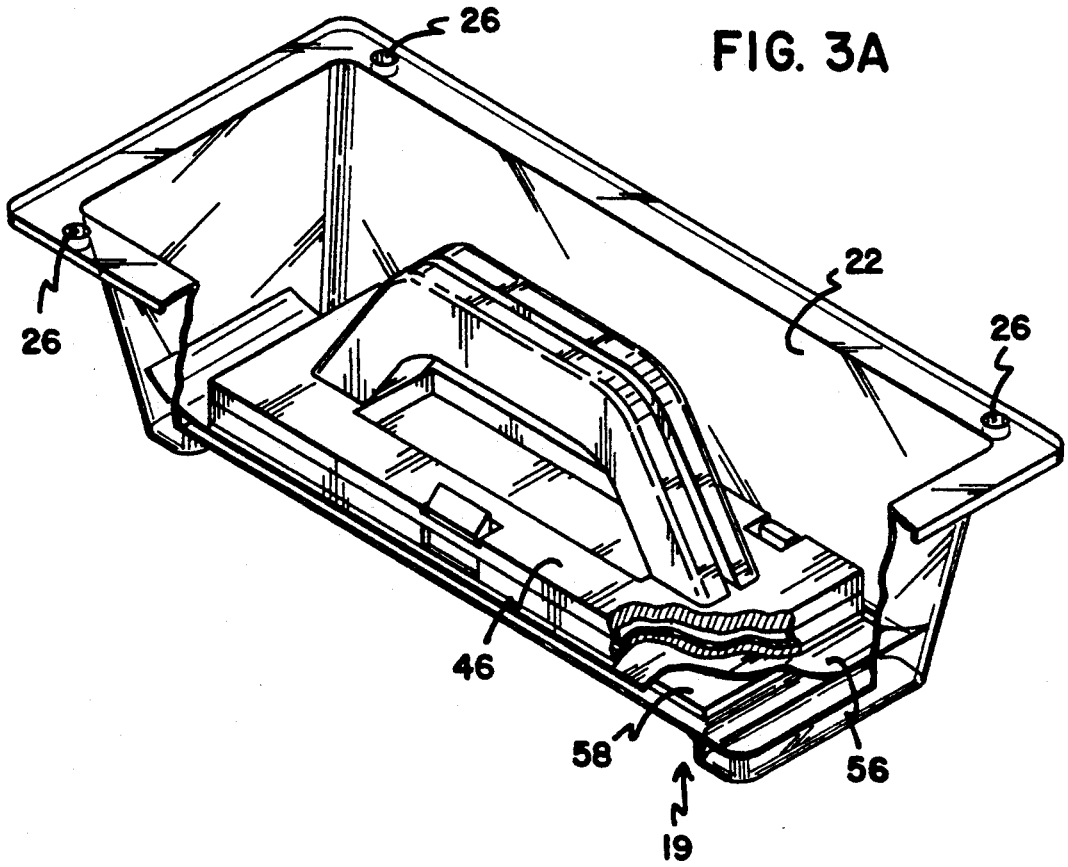
FIG. 3A,B are perspective views of a bottom container portion of the tool kit, wherein tools are present in the bottom container portion in FIG. 3A and are removed from the bottom container portion in FIG. 3B, a portion of the bottom container portion being cut away in FIG. 3A for purpose of illustration.

Additionally, for attaching the top cover portion 24 to the bottom container portion 22, there are four small projections 28 projecting vertically from a flange 24*c* of the top cover portion 24. As illustrated in FIG. 3A,B, the bottom container portion 22 includes a flange 22*a* having four corresponding depressions 26 disposed therein for receiving the projections 28 projecting from the top cover portion 24. The outer diameter of the projections 28 is slightly larger than the inner diameter of the depressions 26 so as to cause an interference fit between the projections 28 and the depressions 26. Accordingly, the top cover portion 24 and the bottom container portion 22 are held together to form the housing 21. Moreover, the top cover portion 24 and the bottom container portion 22 can be non-destructively separated and reattached after use such that the housing 21 serves as a permanent storage case for the tools 23. I will be appreciated that other structures might be used to non-destructively separate and reattach the top cover portion 24 and the bottom container portion 22. Two elongated projections 36 are located proximate opposite ends of the top cover portion 24. The two elongated projections are positioned so as to project into the space defined by the bottom container portion 22 and abut against inner walls at the ends of the bottom container portion 22 so that the projections 28 and the depressions 26 are aligned in longitudinal direction. In the embodiment shown, the projections 36 are shorter than the width of the space defined by the bottom container portion 22. However, in alternate embodiments, the projections 36 might also abut against inner walls of the sides of the bottom container portion 22 so as to align the projections 28 and the depressions 26 in a transverse direction.

Referring now to FIG. 3A there is illustrated in the bottom container portion 22, the piece of sand paper 56, the instruction booklet 58, and the sander 46. This entire assembly will be referred to as a tool kit bottom assembly portion 19. When the tool kit bottom assembly portion 19 is attached to the tool kit top assembly portion 18, the tools 23, the sand paper 56 and the instruction booklet 58 are vertically stacked within the housing 21. The height of the sander 46, the instruction booklet 58 and the sand paper 56 is such that when once stacked, the taping knife blade 30*a* will rest on the sander handle 42 of the sander 46 when the top cover portion 24 is attached to the bottom container portion 22. Thus, the sander 46, sand paper 56 and the instruction booklet 58 will have substantially no horizontal movement because they are compressed between the taping knife blade 30*a* and a bottom surface of the bottom container portion 22. Thus, the entire tool kit 20 is carried by the handle portion 30*b* without any vertical movement and horizontal movement of the contents in the housing.

It will be appreciated that in one embodiment of the invention, the handle of the sander 46 will engage the blade even though the instruction booklet 58 and the sand paper 56 are removed.

In the preferred embodiment, horizontal movement is further restricted by the configuration of the sand paper 56 and the friction between the sand paper 56 and the instruction booklet 58 and between the sander 46 and the sand paper 56. In the embodiment shown, the sand paper 56 has a length at least as great as a length of the bottom container 22 to engage both ends thereof. Moreover, an abrasive side of the sand paper 56 engages the instruction booklet 58 while the back side of the sand paper 56 engages the sponge-like surface 44 of the sander 46. A cover of the instruction booklet 58 preferable faces the surface of the bottom container portion 22 so as to be readable through the clear bottom container portion 22.

Figure 3B:
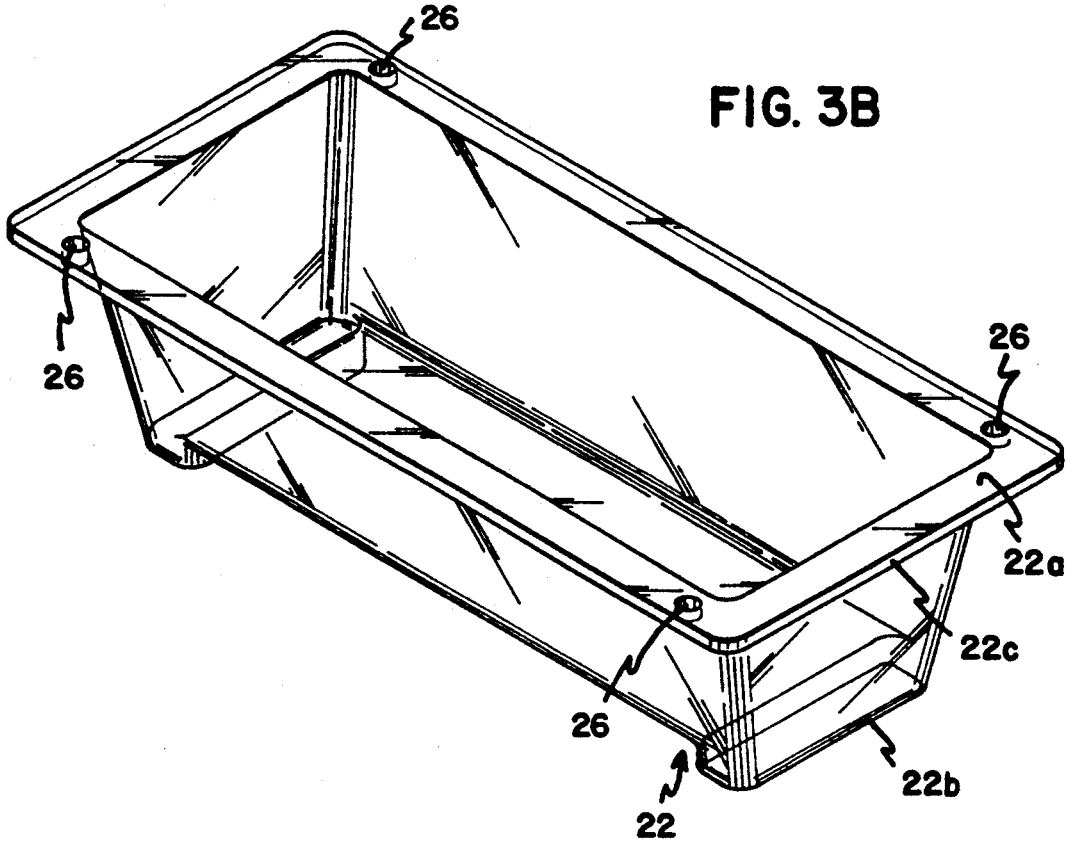

As illustrated in FIG. 3B, the bottom container portion 22 defines a flat bottom container area which can be filled with a substance when the piece of sand paper 56, the instruction booklet 58, and the sander 46 are removed.

The preferred embodiment of the bottom container portion 22 has plastic projecting legs 22*b* which are used to support the bottom container portion 22 such that a bottom surface of the bottom container portion 22 does not engage the support surface on which it rests.

Additionally, the flange 22*a* of the bottom container portion 22 has a downward extending portion 22*c*, which can be used to grasp the tool kit 20 and provides additional structural support.

The preferred embodiment of the housing 21 is made from a molded plastic material. In the preferred embodiment, the top cover portion 24 and the bottom container portion 22 are each molded as an one piece structure. The material might be PVC (polyvinyl chloride) or polystyrene. It will be appreciated that other material such as sheet metal, waxed paper or coated paper, etc., might be used and still be in keeping with the principles of the invention. As can be appreciated, the molded plastic housing 21 functions as a package for carrying and storing the tools 23 and as a display package for the tools 23.

In the preferred embodiment, the top cover 24 includes a label support portion 24*d* extending diagonally across the top cover portion 24. The label support portion 24*d* receives a self-adhesive label 76 whose ends extend or wrap around the flange 24*c* of the top cover portion 24 and the flange 22*a* of the bottom container portion 22 so as to seal the housing 21. The seal assists in holding the top cover portion 24 and the bottom container portion 22 together. The seal also discourage tampering and/or provides an indication of tampering.

One method of packaging the tools in the housing 21 will now be described. The instruction booklet 58 is placed on the flat bottom of the bottom container portion 22. Next, the piece of sand paper 56 is placed with the coarse surface downward on the instruction booklet 58 so that the ends of the sand paper are touching the ends of the bottom container portion 22. Then, the sander 46 is placed with the spongelike surface downward on the sand paper 56, thus forming the tool kit bottom portion assembly 19. The top cover portion 24 is turned upside down, so the recesses 24*a,b* are facing upward. The broad knife 31 is placed into the recess 24*a* of the top cover portion 24. Next, the taping knife 30 is placed into the recess 24*b* of the top cover portion 24 above the broad knife 31, so that the blade 30*a* of the taping knife 30 is retained by the inclined walls or undercuts 32 and the blade support portion 30*c* is retained by the cylindrical projections 34, thus forming the tool kit top portion assembly 18. In the preferred embodiment, the blade 30*a* is placed at the base of the inclined walls or undercuts 32 and then the blade support portion 30*c* is forced past the projection 34. Next, the tool kit top assembly portion 18 and the tool kit bottom assembly portion 19 are aligned by the projections 36 and pressed together so that the four vertical projections 28 on the flange 24*c* of the top cover portion 24 engage the four depressions 26 on the flange 22*a* of the bottom container portion 22. Finally, the label 76 is used to seal the top cover portion 24 and the bottom container portion 22 together. This is accomplished by adhesively applying the label 76 to the label support portion 24*d* so as to extend diagonally across the top cover portion 24 and extend or wrap around the flange 24*c* of the top cover portion 24 and the flange 22*a* of the bottom container portion 22. It will be appreciated that exact procedures and steps may be varied and yet be in keeping with the principles of the invention.

One method of unpackaging the tool kit 20 will now be described. The tool kit 20 is separated into its two portions, the tool kit top assembly portion 18 and the tool kit bottom assembly portion 19, by first breaking the label seal 76 which seals the flange 24*c* of the top cover portion 24 and the flange 22*a* of the bottom container portion 22 and then separating the four projections 28 on the flange 24*c* from the four depressions 26 on the flange 22*a*. The tools 23 are removed from the top cover portion 24 by removing the taping knife 30 from the recess 24*b* of the top cover portion 24. In the preferred embodiment, the blade 30*a* is released from the inclined walls or undercuts 32 by pivoting the blade 30*a* upward and forcing the inclined walls or undercuts 32 outward. The taping knife 30 is then released and can be removed from the recess 24*b*. The broad knife 31 is then removed from the recess 24*a* of the top cover portion 24. The tools are removed from the bottom container portion 22 by removing the sander 46 from the bottom container portion 22. Then, the sand paper 56 and the instruction booklet 58 are removed from the bottom container portion 22. It will be appreciated that exact procedures and steps may be varied and yet be in keeping with the principles of the invention.

It will be appreciated that alternate embodiments in keeping with the principles of the present invention might be utilized. The embodiment shown has included specific types of tools although other tools might be similarly packaged in keeping with the principles of the invention. It is to be understood, however, that even though numerous characteristics and advantages of the invention would be set, together with details of the structure and function of the invention, the disclosure is illustrative only, and changes may be made in detail, especially in matters of shape, size and arrangement of parts, within the principle of the invention, to the full extent indicated by the broad general meaning of the terms in which the appended claims are expressed.

What is claimed is:

1. A took kit, comprising:

a housing having a bottom container portion and a removable top cover portion, at least a portion of the housing being at least partially transparent;

a plurality of hand tools being disposed in the housing, at least some of the tools being disposed in a vertically stacked arrangement, the top cover portion including tool-receiving recess means for receiving at least some of the vertically stacked tools, the top cover portion including means for retaining at least one of the vertically stacked tools within the recess means of the top cover portion, vertical and horizontal movement of the vertically stacked tools being substantially prohibited, at least some of the tools being visible in the housing from outside the housing;

wherein one of the tools has a handle portion and a blade portion, the housing having an opening through which the handle portion projects, the retaining means retaining the blade portion in the top cover portion, the tool kit being capable of being carried by grasping the handle portion of the tool; and wherein the bottom container portion of the housing defines a container area for holding a substance when the tools are removed.

2. A tool kit in accordance with claim 1, wherein the bottom container portion is opaque.

3. A tool kit in accordance with claim 1, wherein the plurality of hand tools include a hand sander, a broad knife and a taping knife.

4. A tool kit further in accordance with claim 3, wherein a piece of sand paper and an instruction booklet are present in the bottom container portion.

5. A tool kit in accordance with claim 1, wherein the bottom container portion is made of one piece and the top cover portion is made of one piece.

6. A tool kit in accordance with claim 1, wherein at least some of the vertically stacked tools support one another.

7. A tool kit in accordance with claim 1, wherein the top cover portion includes projection means for prohibiting vertical movement of at least some of the vertically stacked tools.

8. A took kit in accordance with claim 1 wherein the top cover is comprised of transparent material.

9. A tool kit in accordance with claim 8, wherein the housing is made of a material selected from one of polyvinyl chloride and polystyrene.

10. A tool kit in accordance with claim 8, wherein the bottom container portion is opaque.

11. A tool kit in accordance with claim 1, wherein the top cover portion and bottom container portion are retained together by an adhesive label.

12. A tool kit in accordance with claim 1, wherein the top cover portion includes elongated projection means for aligning the top cover portion and the bottom container portion.

13. A tool kit, comprising:

a housing having a bottom container portion and a removable top cover portion;

a plurality of tools being disposed in the housing, at least one of the tools being a hand tool having a blade portion and a handle portion;

means for retaining at least one of the tools in the top cover portion; and wherein the housing has an opening through which the handle portion of a said hard tool projects, a majority of the handle portion being disposed on the outside of the housing, the retaining means retaining the blade portion in the top cover portion, wherein the tool kit is capable of being carried by grasping the handle portion of the said hand tool.

14. A tool kit in accordance with claim 13, wherein the handle portion disposed on the outside of the housing has an opening.

15. A tool kit in accordance with claim 13, one of the tools being sander means for sanding surfaces.

16. A tool kit in accordance with claim 13, wherein the top cover portion is sufficiently transparent so as to allow the hand tool to be seen from the outside of the housing.

17. A tool kit in accordance with claim 13, wherein one end of the handle portion is generally attached to one edge of the blade portion, the blade portion having a width which is greater than a width of the handle portion so as to provide the hand tool with a generally T-shape configuration, wherein the blade portion is the top of the T-shape configuration and the handle portion is the bottom of the T-shape configuration, the handle portion and the housing also having a generally T-shape configuration.

18. A tool kit in accordance with claim 13, wherein the top cover portion includes means for retaining the blade portion so that the blade portion of the T-shape hand tool is disposed in the top cover portion of the housing.

* * * * *